US007203430B2

(12) United States Patent
Ohta

(10) Patent No.: US 7,203,430 B2
(45) Date of Patent: Apr. 10, 2007

(54) ON-LINE HELP METHOD, SOFTWARE AND SYSTEM FOR NETWORK DEVICES

(75) Inventor: Yasutoshi Ohta, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 239 days.

(21) Appl. No.: 10/957,262

(22) Filed: Oct. 1, 2004

(65) Prior Publication Data

US 2005/0078968 A1 Apr. 14, 2005

(30) Foreign Application Priority Data

Oct. 9, 2003 (JP) ..... 2003-350686

(51) Int. Cl.
*G03G 15/00* (2006.01)

(52) U.S. Cl. ..... 399/8; 399/9; 399/10; 399/81

(58) Field of Classification Search ..... 399/8, 399/9, 11, 81, 82, 83, 85; 358/1.15, 1.16; 708/173; 379/102.01, 106.01
See application file for complete search history.

(56) References Cited

U.S. PATENT DOCUMENTS 6,606,460 B2 * 8/2003 Konno ..... 399/9
2003/0086109 A1 * 5/2003 Fitch ..... 358/1.14
2004/0162890 A1 * 8/2004 Ohta ..... 709/218

FOREIGN PATENT DOCUMENTS

| | | |
|---|---|---|
| JP | 2001-312462 | 11/2001 |
| JP | 2002-016749 | 1/2002 |
| JP | 2002-258682 | 9/2002 |

* cited by examiner

*Primary Examiner*—Hoan Tran
(74) *Attorney, Agent, or Firm*—Knoble Yoshida & Dunleavy, LLC

(57) ABSTRACT

The on-line help or support system responds to a user help request in a responsive manner. In advance of the user help request, the on-line help system determines if the user is possibly in need of help information based upon the sequence of operational key inputs. The on-line help system monitors and analyzes the user key inputs according to a predetermined set of rules. In case of a possible confusion state for a certain operation for an image-forming device, the on-line help system obtains the corresponding relevant help information from a predetermined help server on the network even though the user has not yet requested for the help. The down loaded help information is stored in a cache memory.

42 Claims, 10 Drawing Sheets

ON-LINE HELP METHOD, SOFTWARE AND SYSTEM FOR NETWORK DEVICES

FIELD OF THE INVENTION

The current invention is generally related to an on-line help or support for the operation of network-connected devices including image-forming devices on the network, and more particularly related to on-line systems, methods and software programs for supporting the users in operating image-forming devices that are connected to the network via the Internet protocols.

BACKGROUND OF THE INVENTION

As the image-forming devices include multiple functions and additional features, the operation of these image-forming devices has become highly complex. In recent years, the single image-forming devices have multiple functions for copiers, printers, facsimiles and scanners. In addition, certain image-forming devices also include application duplicate functions. One exemplary application duplicate function is to copy two one-sided pages into a single two-sided page. Another exemplary application duplicate function is to copy each page of the open book into a separate output page. As the multiple functions are integrated into single image-forming devices, the complexity has also grown and the users have frequent questions on the functions and the operations. In the past, the users learned the functions and the operations from manuals that are provided at the delivery of the image-forming devices.

Newer image-forming devices have a large display panel such as a liquid crystal display (LCD) for displaying help information. For example, after selecting a key for a function to be performed, the corresponding help information is automatically displayed at the LCD. Alternatively, a menu for the selected key is displayed for finding help. In the recent image-forming devices, the above electronic reference or help has become a major force, and the help text is directly referred by the user.

As the complexity has grown in the image-forming devices, an amount of the electronic help text has also significantly increased for sophisticated features and the integrated multiple functions. Consequently, the storage capacity for the electronic help text has become an issue. That is, the associated costs for a sufficiently large storage capacity are almost prohibitive for the image-forming device. Furthermore, the large help information or text is not always helpful. Since the installation environment varies for the image-forming devices, some of the help information is not necessary. For example, the factors for installation environment include an installation location, a department or section where the device is located and the user preference for the operation. These factors demand various sets of help information. Another exemplary factor is that the help information increasingly needs to be multiple languages even if the image-forming devices are installed in Japan as numerous businesses become global. Because of the above described factors, it has become impossible to install a necessary set of the help information in the factory at the delivery time.

To improve the above described problems, a network-based help method has been proposed. The help text is stored in a predetermined network server, and the image-forming device accesses the help server to download the help information as necessary. The above network help facility on-line support or on-line help method solves the cost issues associated with the large memory capacity in the image-forming device. Furthermore, the on-line help also facilitates to always provide the user with the most updated help information. Another advantage is that the on-line help enables the administrator to collect historical data on accessing the help information in the help server.

According to Japanese Patent Publication 2001-312462, an on-line help technique provides instructions for guiding the user to operate a specific image-forming device in an appropriate manner. Upon analyzing a received operational manual request from the image-forming device, the on-line help system searches the corresponding operational information in the storage media and downloads the searched operational information to the originally requesting image-forming device such as a digital copier. The essential information in the downloaded manual is displayed to the user at the digital copier for the current operational status so that the subsequent operation is smoothly performed.

According to Japanese Patent Publication 2002-16749, an image-forming device is connected a server of the manufacturer via the Internet. The display data for various situations is in a language or expression suitable for the Internet environment and is stored at either the image-forming device or the manufacturer server. In response to a type and a degree of the currently occurring situation, a corresponding data is searched and displayed through a user-interface. This technique provides the most updated version of the detailed and easily understandable guiding information without the substantial increase in the memory capacity at the image-forming device.

According to Japanese Patent Publication 2002-258682, an image-forming device is equipped with a video camera for capturing the changing facial expressions of the user. Based upon a coordinate change of the predetermined characteristic point in the facial elements, the contraction in facial muscles is detected. It is then determined as to whether or not the user is confused about the operation of the image-forming device based upon the detected contraction amount in the facial muscles. In response to the user confusion, a help guidance display or a help menu is automatically displayed for enabling prompt and smooth handling by the user.

In the above prior art on-line techniques as disclosed in Japanese Patent Publications 2001-312462 and 2002-16749, it takes an undesirable amount of time to download the help information when the access to the help server is through a relatively slow line. Furthermore, the amount of the download time is corresponding to the size of the help information. The response time is thus generally long before displaying the help information since the user depresses the help button on the image-forming device. Due to the long response time, the current task is interrupted and delayed. Consequently, the user experiences some stressful situation.

In the above prior art video technique as disclosed in Japanese Patent Publication 2002-258682, the associated cost is prohibitive for the video camera and the image processing. In order to determine the change in the facial expression, the video camera must have high resolution and must be adaptable. Furthermore, a voluminous amount of data must be processed to detect the confusion in the facial expressions.

In view of the above described prior art problems, the help facility on a complex image-forming device remains to be desired for substantial improvement.

SUMMARY OF THE INVENTION

In order to solve the above and other problems, according to a first aspect of the current invention, a method of helping a user in operating an image-forming device that is connected to a help server via a network, including the steps of monitoring a user key input sequence of user input keys at the image-forming device, determining a user confusion state in operating the image-forming device based upon the monitored user key input sequence, automatically downloading from the help server a relevant set of help information in accordance with the user confusion state, and temporarily storing the relevant set of the help information in a temporary memory unit at the image-forming device in advance of a user help request for the relevant set of the help information.

According to the second aspect of the current invention, a computer program for helping a user in operating an image-forming device that is connected to a help server via a network, performing the tasks of monitoring a user key input sequence of user input keys at the image-forming device, determining a user confusion state in operating the image-forming device based upon the monitored user key input sequence, automatically downloading from the help server a relevant set of help information in accordance with the user confusion state; and temporarily storing the relevant set of the help information in a temporary memory unit at the image-forming device in advance of a user help request for the relevant set of the help information.

According to the third aspect of the current invention, a system for helping a user in operating an image-forming device via a network, including a help server connected to the network for storing help information; and an image-forming device connected to the network and having a user input unit for monitoring a user key input sequence of user input keys and an information processing unit for determining a user confusion state in operating the image-forming device based upon the monitored user key input sequence, the image-forming device further including an I/O control unit for downloading from the help server a relevant set of the help information in accordance with the user confusion state, the image-forming device further including a temporary memory unit for temporarily storing the relevant set of the downloaded help information at the image-forming device in advance of a user help request for the relevant set of the help information.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Based upon incorporation by external reference, the current application incorporates all disclosures in the corresponding foreign priority document (Japanese Patent Application 2003-350989 as filed on Oct. 9, 2003) from which the current application claims priority.

Figure 1:
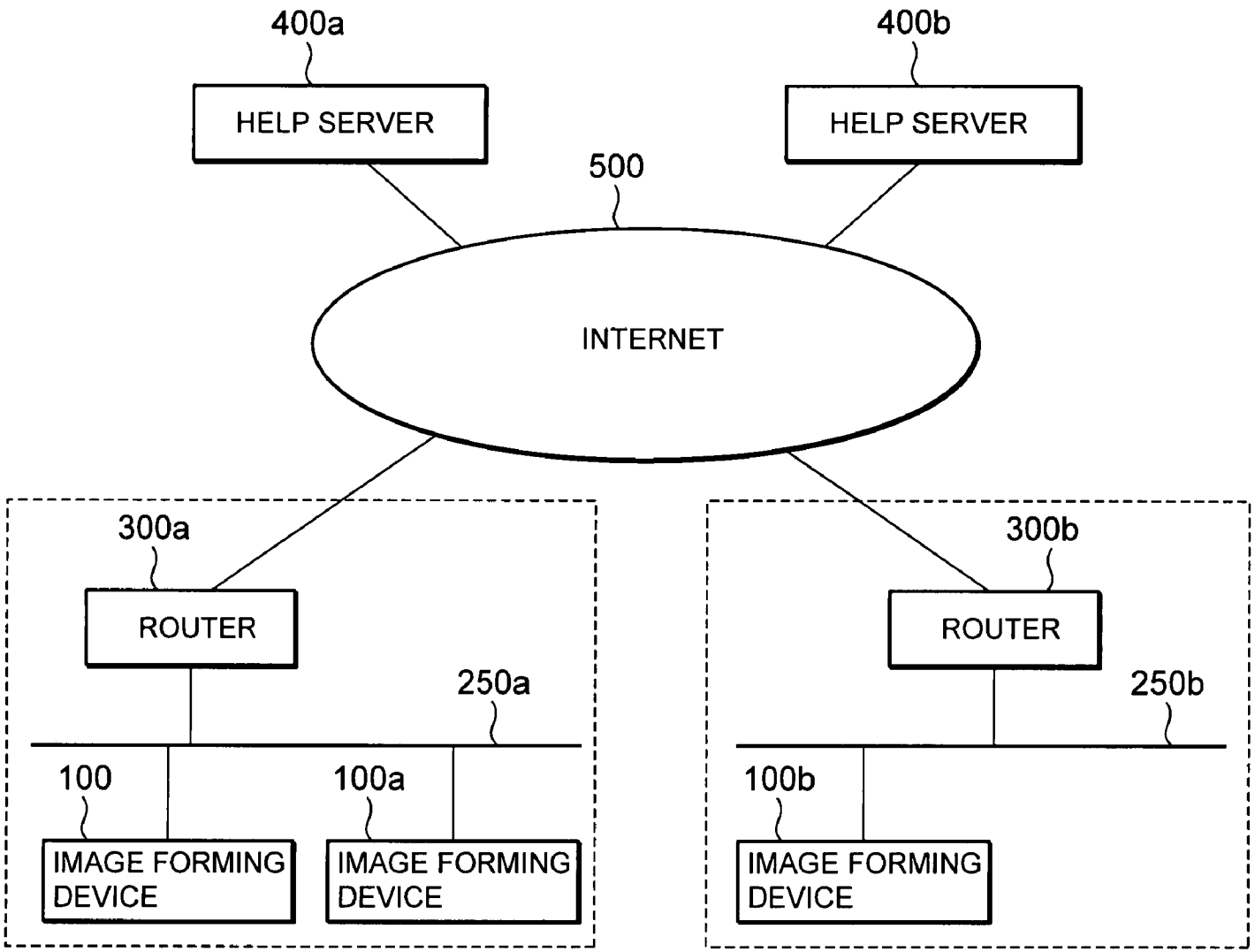
FIG. 1 is a diagram illustrating a preferred embodiment of the on-line support system for an image-forming device according to the current invention.

Referring now to the drawings, wherein like reference numerals designate corresponding structures throughout the views, and referring in particular to FIG. 1, a diagram illustrates a preferred embodiment of the on-line support system for an image-forming device according to the current invention. The image-forming devices 100, 100*a* and 100*b* include a multi-function machine, a copier, a printer, a scanner and a facsimile. In general, the image-forming device is ultimately connected to a network such as the Internet 500 for inputting from and outputting to the network. Within a local area network (LAN), the first LAN 250*a* is connected to the image-forming devices 100 and 100*a* and a first router 300*a*, which in turn is connected to the Internet 500. Similarly, the second LAN 250*b* is connected to the image-forming devices 100*b* and a second router 300*b*, which in turn is connected to the Internet 500. In the above described network environment, a first help server 400*a* and a second help server 400*b* are connected to the image-forming devices 100, 100*a* and 100*b* via the Internet 500. In other words, the image-forming devices 100, 100*a* and 100*b* each have access to the first help server 400*a* and the second help server 400*b* via the Internet 500 through the router 300*a* or 300*b*. The first help server 400*a* and the second help server 400*b* are directly connected to the Internet 500. The help or support information according to the current invention is stored in the help servers 400*a* and or 400*b*. Alternatively, the help servers 400*a* and 400*b* are connected to the image-forming devices 100, 100*a* and 100*b* within the LAN or an intra network. The image-forming devices 100, 100 and 100*b* is equipped with the world wide web (Web) browser function as well as the communication function. The help servers 400*a* and 400*b* is equipped with the Web browser function.

Figure 2:
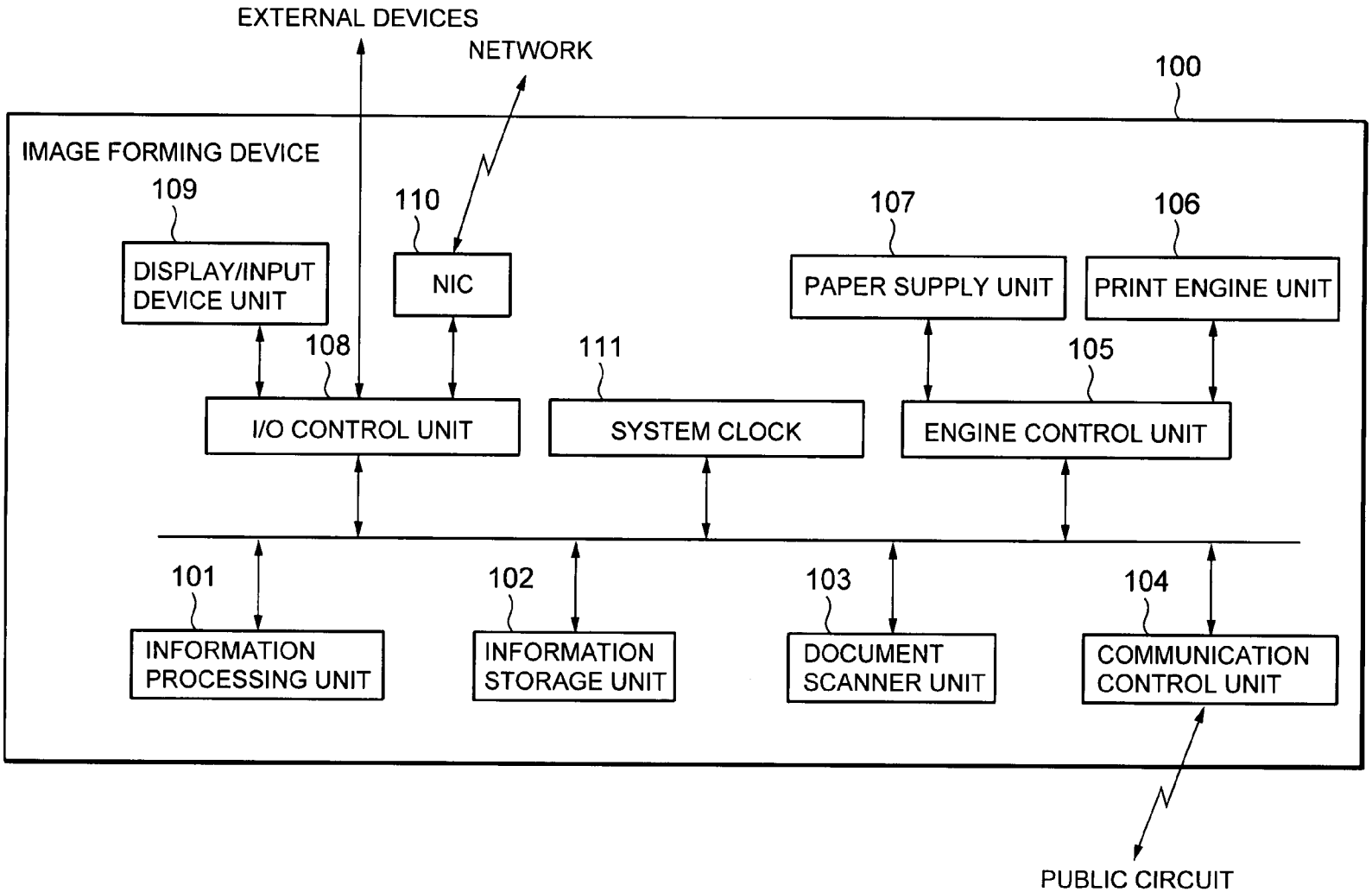
FIG. 2 is a block diagram illustrating one preferred embodiment of the image-forming device according to the current invention.

Now referring to FIG. 2, a block diagram illustrates one preferred embodiment of the image-forming device 100 according to the current invention. The image-forming device 100 is substantially identical to the image-forming devices 100*a* and 100*b* and includes a copy function, a facsimile function, a scanner function and a printer function. The image-forming device 100 further includes an information processing unit 101 for controlling the overall units, an information storage unit 102 for storing various control software programs and data, a document scanner unit 103 for scanning documents with an automatic document feeder (ADF), a communication control unit 104 for connecting to the public switched telephone network (PSTN) according to a predetermined facsimile transmission protocol, a print engine unit 106 for outputting an image at a predetermined resolution level and a paper supply unit 107 for controlling the supply and delivery of image-recording media. The image-forming device 100 also further includes an input output (I/O) control unit 108 for controlling the input and output to and from an external device and the image-forming device 100, a display/input device 109 for displaying and inputting information, a network interface card (NIC) 110 for interfacing with the network and a system clock 111 for generating the clock signals.

Still referring to FIG. 2, the information processing unit 101 controls the overall functions of the image-forming device 100 by executing the control programs that are stored in the information storage unit 102. For example, the running control software program detects an input from the user via the input device 109. Since the user input rate via keys is much slower than the processing rate by the information processing unit 101, the user input is processed by the control program that is executed by the information processing unit 101. Alternatively, if the information processing unit 101 needs to be dedicated for executing a complex algorithm, a separate processor is placed in the information processing unit 101 for detecting user input in another preferred embodiment. The information storage unit 102 further includes a read-only memory ROM for storing the control programs for the image-forming device, a random access memory RAM to be used as a work memory area, a hard disk device and a flash memory. Some of the help or support information according to the current invention are stored in the hard disk device and or the flash memory of the image-forming device 100. Furthermore, the help information optionally includes only pointers or universal resource locators (URL) to the body of the corresponding help information that is stored elsewhere. Others of the help or support information according to the current invention are stored in the help servers 400*a* and or 400*b* that are connected to the Internet 500 as described with respect to FIG. 1. In other words, the help or support information according to the current invention is distributed among the help servers 400*a* and 400*b* and the image-forming devices 100, 100*a* and 100*b*. Furthermore, the help information stored in the help servers 400*a* and 400*b* has a help function portion and a universal resource locator (URL) pointer to a corresponding help information portion.

The information storage unit 102 further includes a cache memory device or memory storage unit that is a temporary memory unit. When image-forming device 100 receives the requested help information from the help server 400, the help information is placed in the cache. Alternatively, the cache is implemented as a separate unit from the information storage unit 102 in an alternative embodiment. In the following, the information storage unit 102 is synonymously used as a cache unit. The cache control is an independent process in the operating system of the image-forming device 100. If the desired help information is not in the cache, the image-forming device 100 requests the help server 400 to transmit the desired help information to the image-forming device 100. The transmitted help information is stored in the cache as long as free space exists in the cache. As the free space decreases to a predetermined level, the cache control automatically removes old ones of the help information based upon the date and time stamp of the existing help information so as to create free space for the newly received help information. Furthermore, the cache also stores the digital signal from the document scanner unit 103 and or the image information that has been converted from the digital signal by the information processing unit 101. The above image information in the cache is transmitted to the print engine unit 106 via the engine control unit 105 when the image is transferred onto an image-transfer sheet by the print engine unit 106. The corresponding image information is then removed from the cache upon delivering the image-transfer sheet.

Other units of the image-forming device 100 will be further described here. The document scanner unit 103 further includes the ADF, a light source and an image capturing element such as a capacitor coupled device (CCD). The scanned image is converted from the optical signal to the corresponding electrical or digital signal, and the converted digital signal is transmitted to the information storage unit 102. Although the ADF allows a continuous automatic scanning operation of multiple pages without manually feeding each page at a time, for the practice of the current invention, the ADF is not necessary. The communication unit 104 is connected to a public circuit or network such as PSTN and includes a facsimile modem for performing a predetermined facsimile communication protocol. The print engine unit 106 and the paper supply unit 107 are connected to the engine control unit 105. The paper supply unit 107 further includes a plurality of paper trays for containing image-transfer sheets, and a desired image is formed on the image-transfer sheet by an electrophotographic method according to the digital signal and or the image information that has been converted from the digital signal from the information storage unit 102. The I/O control unit 108 establishes the connection to an external device and further includes a parallel port, a serial port and or an universal serial bus (USB). The I/O control unit 108 is also connected to the display/input device unit 109 and to the NIC 110. The display/input device unit 109 further includes a liquid crystal display for displaying the operational steps and the instructions of the image-forming device 100 and a touch panel for receiving input from the user. The NIC unit 110 connects the image-forming device 100 to the EtherNet cable of the LAN 250 for processing the protocol such as hyper text transfer protocol (HTTP) and transmission control protocol/Internet protocol (TCP/IP). The NIC unit 110 has an interface function with the Internet 500 via the predetermined protocol for the transmission control protocol. The system clock unit 111 outputs the clock signal including the current time.

Figure 3:
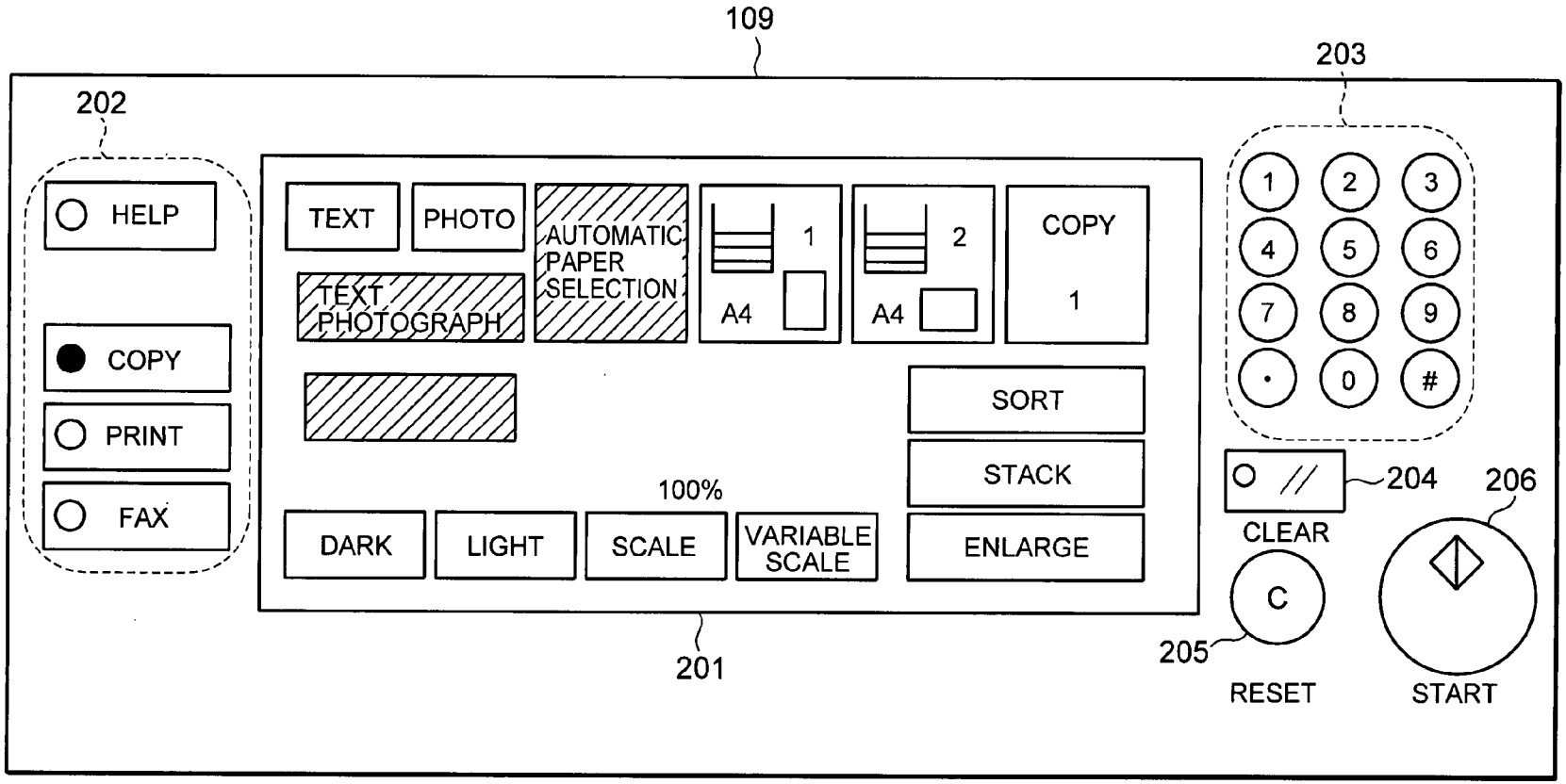
FIG. 3 is a block diagram illustrating a top view of one preferred embodiment of the display/input device unit according to the current invention.

Now referring to FIG. 3, a block diagram illustrates a top view of one preferred embodiment of the display/input device unit 109 according to the current invention. In the center of the display/input device unit 109, a touch panel 201 is located for displaying information and receiving input from the user. The touch panel 201 displays the setting items such as the output sheet size selection, the delivery selection, the scale/size selection, the text/photo selection and the intensity selection for the predetermined functions 202 such as HELP, COPY, PRINT and FAX. The user selects the option on the touch panel 201. To change the functions, the user selects a function from the predetermined set of the function keys 202. The right of the touch panel 201 is common keys including numerical keys 203, a clear key 204, a reset key 205 and a start key 206.

Figure 4:
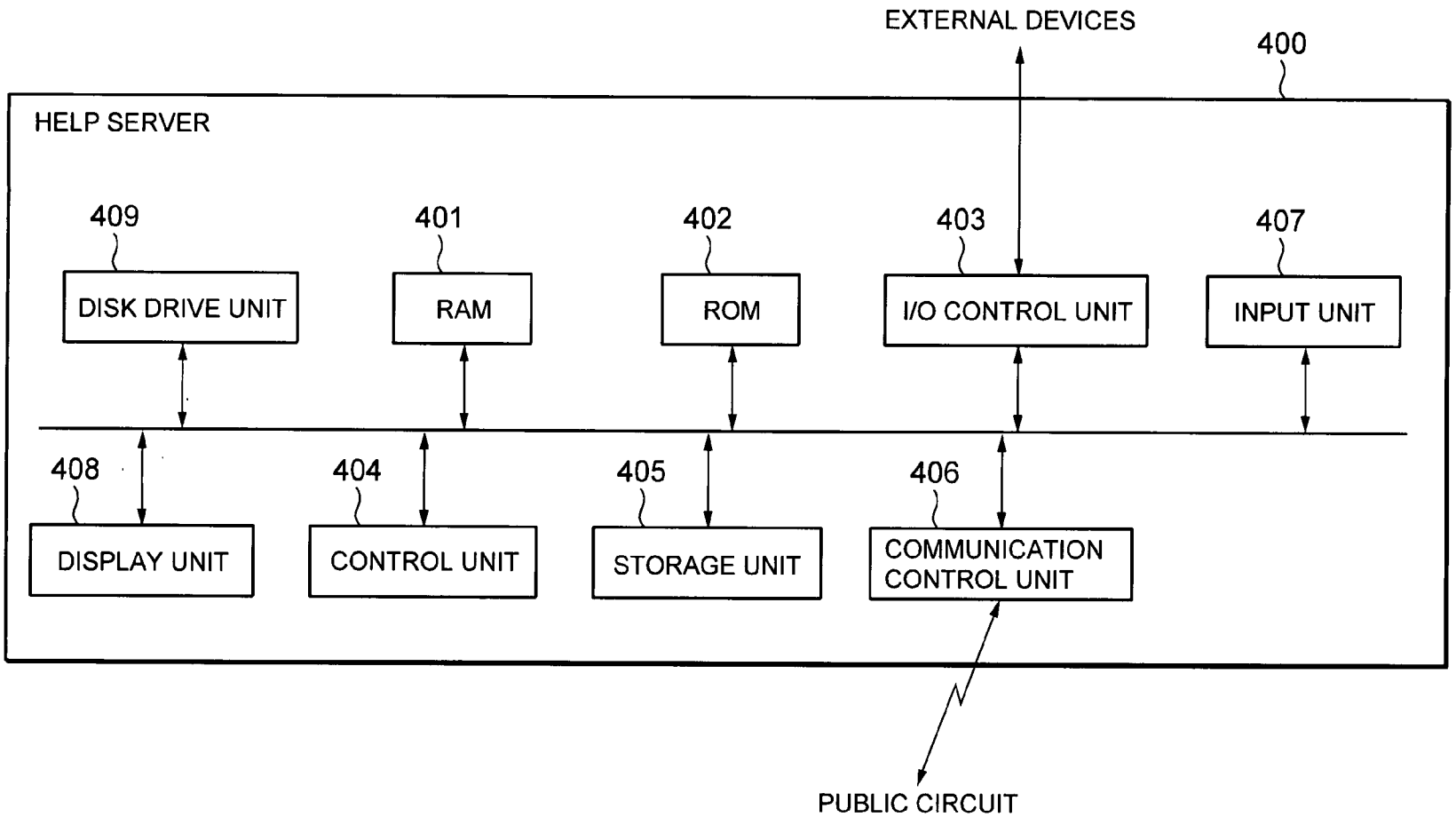
FIG. 4 is a block diagram illustrating one preferred embodiment of the help server 400*a* according to the current invention.

Now referring to FIG. 4, a block diagram illustrates one preferred embodiment of the help server 400*a* according to the current invention. The help server 400*a* is substantially identical to the help server 400*b* and further includes a random access memory (RAM) unit 401, a read-only memory (ROM) unit 402, an input output (I/O) control unit 403 for controlling the input and output to and from an external device through a serial port, a parallel port or SUB, a control unit 404 for controlling the overall functions, an information storage unit 405 such as a hard disk, a communication unit 406 such as a network board, a input device unit 407 such as a keyboard and a mouse, a display unit 408 such as a liquid crystal display and a disk drive unit 409 for reading a software program and data from a storage medium such as a flexible disk. The information storage unit 405 stores various software programs including an operating system program, a help search program for searching requested help information and a Web server program for downloading the searched help information. As it is necessary, any of the above software programs is read into the RAM 401 for execution. To practice the current invention, any operating system is acceptable. Similarly, no specific software programs are necessary for searching the help information and downloading the searched information as long as they are compatible with the operating system software. The Web server program is loaded in the RAM 401 at the activation of the help server 400 and is executed in the background in response to the request from the image-forming device 100. As long as the capacity of the information storage unit 405 and the traffic to access the help server 400 allow, a single one of the help server 400 supports a plurality of the image-forming devices 100 according to the current invention. Alternatively, a plurality of the help servers 400 is provided to a predetermined number of the image-forming device(s) 100 for offering the help information in order to reduce load for each of the help servers 400.

In response to the request from the image-forming device 100, as the necessary help information is transmitted, one serendipitous effect is that the Web server program automatically logs the accessed items in the help server 400. That is, based upon the access log, frequently accessed help items indirectly indicate that the users tend to be confused for the operation of these frequently accessed items. The above indication is important information for a designer to improve the user interface in the image-forming devices 100.

Figure 5A:
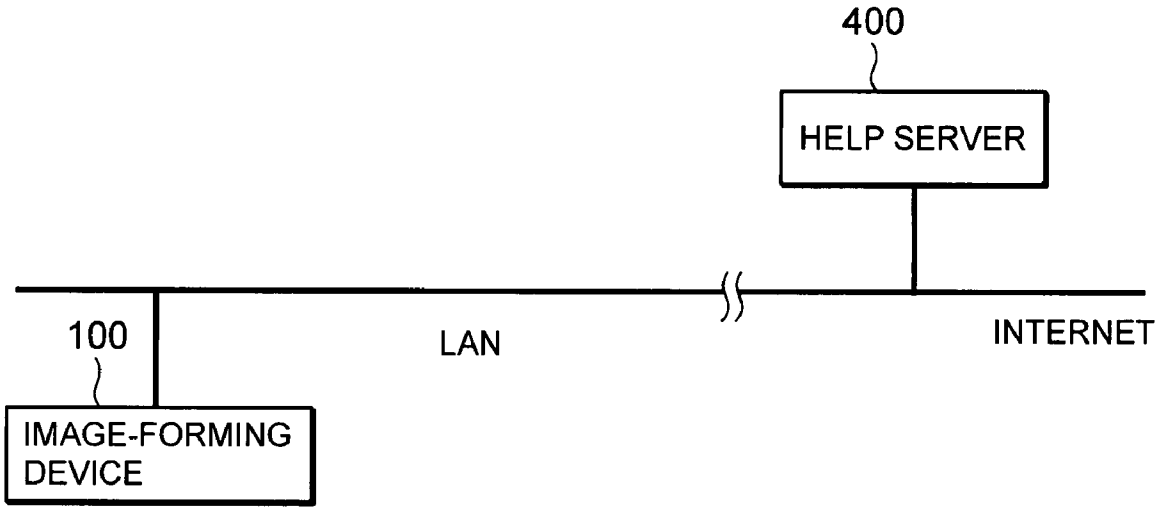
FIGS. 5A and 5B are diagrams illustrating general flows in processing the help information request according to the current invention.
Figure 5B:
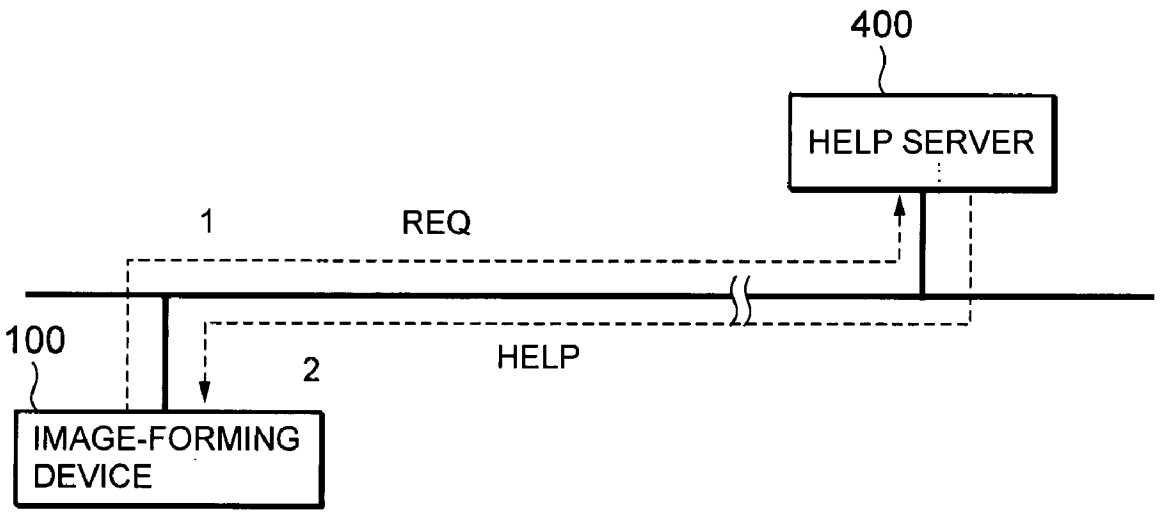

Now referring to FIG. 5, diagrams illustrate general flows in processing the help information request according to the current invention. After the user presses the help function key 202 of FIG. 3 for selecting desired help information, the image-forming device 100 initially searches the desired help information in the information storage unit 102 of the image-forming device 100 as shown in FIG. 5A. If the desired help information is found in the information storage unit 102, the desired help information is displayed on the display unit 109 of the image-forming device 100. In this case, no network traffic is generated as shown in FIG. 5A. On the other hand, if the desired help information is not found in the information storage unit 102, a corresponding pointer or URL for the desired help information is read from the information storage unit 102, the request including the URL is transmitted to the help server 400 via the http protocol over the Internet as shown in a dotted line 1 of FIG. 5B. If the help server 400 successfully downloads the desired help information in the image-forming device 100 as shown in a dotted line 2 of FIG. 5B, the downloaded information is stored in the information storage unit 102 and is displayed on the display unit 109 of the image-forming device 100.

Figure 6A:
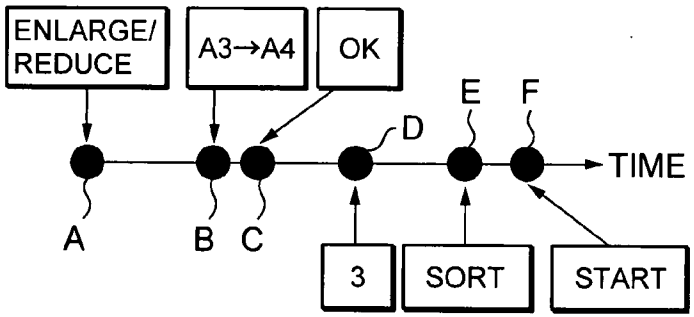
FIGS. 6A and 6B are diagrams illustrating the steps involved in a preferred process of monitoring the user input keys and responding to the input according to the current invention.

Now referring to FIG. 6, diagrams illustrate the steps in a preferred process of monitoring the user input keys and responding to the input according to the current invention. The horizontal axis is time over which the user initiates the operation in both diagrams. The user input is monitored or processed by the control program that is executed by the information processing unit 101. The above monitoring software program a type of the input key, an amount of time between the two input keys and an amount of time before the start key is depressed. Referring particularly to FIG. 6A, it is illustrated that the user already knows the user input key sequence for copying a reduced size of the original document and sorting three sets. For reduction, the pressed the enlarge/reduce key at time A followed by the A3 to A4 key at time B and the OK button at time C. For sorting, the presses a number "3" key at Time D followed by the sort key at Time E and the Start key at Time F. Because of the familiarity of the user input key sequence for the above operation, the user depresses the six keys within a relatively short period of pause between two keys at Times A through F.

Figure 6B:
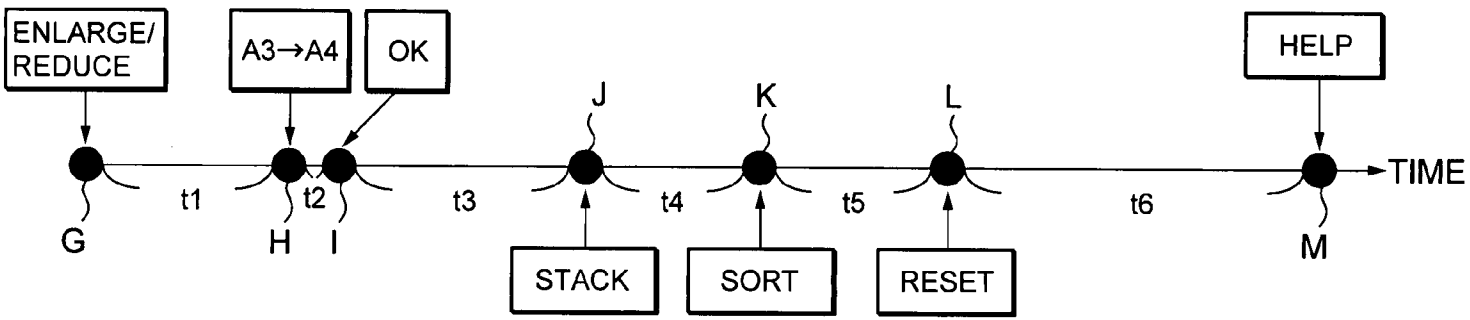

In contrast, referring particularly to FIG. 6B, it is illustrated that the user does not know the user input key sequence for copying a reduced size of the original document and sorting three sets. For reduction, the user presses the enlarge/reduce key at Time G but not immediately followed by the A3 to A4 key at Time H and the OK button at Time I. Because of the unfamiliarity, it takes some time t1 for the user to find the A3 to A4 key at Time H. For sorting, the user depresses the stack key at Time J after a time t3 after depressing the OK button at Time I. Although the sorting operation and the stacking operation are mutually exclusive and cannot be selected together, the user presses the sort key at Time K after a time t4 after pressing the stack button. From the above combination of incompatible key sequence at Times J and K, it is inferred that the user is substantially confused about the key sequence operation. Furthermore, the user presses the reset key after time t5 at time L. Lastly, the user presses the help button at Time M after a significant pause of t6.

Still referring to FIG. 6B, based upon the above described user input key sequence, it is determined in real time whether or not the user is confused about his or her current operation, and the proper help information is prepared. For example, one of the simplest responses is to download the corresponding help information in advance at the time when the user depresses the certain function keys such as the reduction key at Time A, the stack key at Time J or the sort key at Time K. Although the above described advance downloading process is simple, unnecessary help information may be downloaded. Another way to determine the user confusion focuses upon the user key input time. In particular, according to a first technique, an amount of time is monitored since the initial user key input. After Time G for the reduction key, if the pause t I exceeds a predetermined amount of time, it is regarded that the user is now confused about the current operation. For example, if the predetermined amount of time is between (t1+t2) and (t1+t2+t3), help information is downloaded in advance for any operation after and including the stack key at Time J and is cleared by the Start key input. The above described predetermined time value is stored in the information storage unit 102, and the information processing unit 101 continuously monitors the in-between input key time from the initial user key input at Time G.

There are three other techniques to determine the user confusion status. According to a second technique, a pause between the key inputs is monitored. If no user key is inputted after a predetermined amount of time since the last user input key, it is regarded that the user is confused about the current operation. The corresponding help information is downloaded for the current confused operation before the user request the information. For example, if the predetermined amount of time is t2, the help information is downloaded at every operation at Time G, I, J, K and L except for the A3 to A4 operation at Time H. According to a third technique, an input key frequency of a certain key is focused. For example, a familiar user almost never uses a special key such as a reset key during the operation. Based upon the input frequency of a predetermined special key, it is determined whether or not a user is in a confused state. If the predetermined input frequency of the reset key is once within a unit time covering Time G through L, the corresponding help information is downloaded at Time L when the reset key is pressed. Lastly, according to a fourth technique, a key sequence or order is focused to determine the user confusion. In the above example as shown in FIG. 6B, at Time J, the stack key is pressed while at Time K, the sort key is pressed. As described above, the sort key and the stack key are mutually exclusive functions and cannot be combined in the same sequence by an experienced user. Thus, it is determined based upon a predetermined prohibited key sequence that the user experiences confusion on the sort and stack key operations and the corresponding help information is downloaded. Although the above example illustrates the prohibited key combination of the sort and stack key, the predetermined key sequence includes any other prohibited or nonsensical key combination sequence. In summary, the control program monitors a sequence of the user key input in real time, and certain help information is prepared in advance according to predetermined criteria such as a predetermined threshold value and a predetermined pattern. Thus, the responsiveness of the on-line help system is substantially improved for reducing the user stress.

Figure 7:
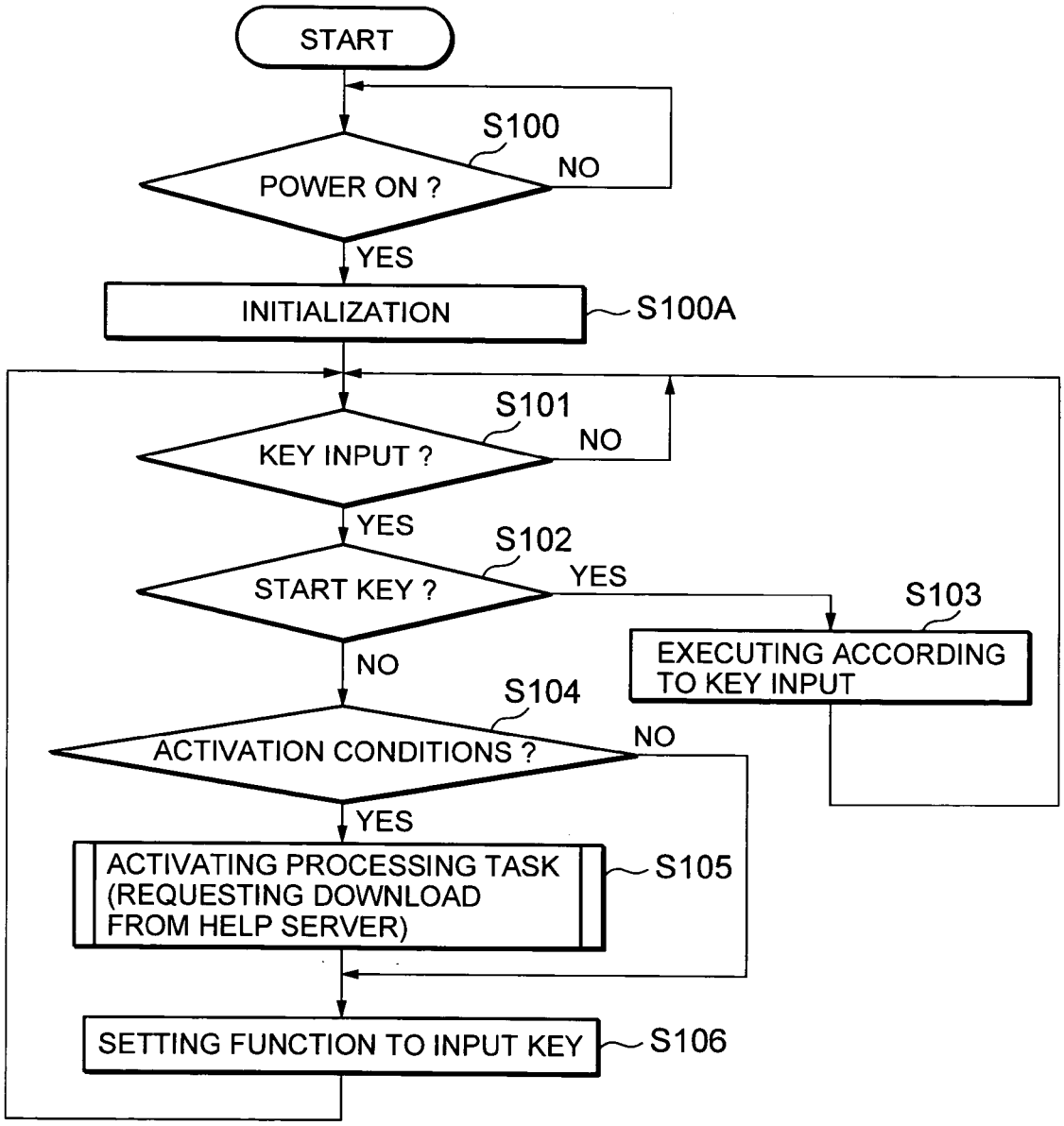
FIG. 7 is a flow chart illustrating steps involved in a preferred process of performing the on-line user support according to the current invention.

Now referring to FIG. 7, a flow chart illustrates steps involved in a preferred process of performing the on-line user support according to the current invention. In general, certain help information is downloaded in advance of the user help request based upon the user input key sequence. In describing the steps in the preferred process, although the devices such as of the image-forming device 100 and the help server 400 or the units of these devices are referred, the implementation of the preferred process is not limited to these units or devices and is merely illustrative. It is initially determined in a step S100 whether or not the power is on in the image-forming device 100. If it is not powered on in the step S100, the preferred process waits till power on. Upon the powering on, an initialization step is performed in a step 100A according to the information processing unit 101. After the initialization, the image-forming device 100 waits for a predetermined set of user key input in a step S101. When it is determined in the step S101 that the user has inputted one or more of the predetermined function or setting keys, it is further determined in a step S102 whether or not the start key has been subsequently inputted. If it is determined in the step S102 that the start key has been subsequently inputted, the preferred process proceeds to a step S103, where the requested function is performed according to the specified conditions and then returns to the step S101, where the preferred process waits for another set of the key inputs. On the other hand, if it is determined in the step S102 that the start key has not been subsequently inputted, the subsequently entered key input is not the start key, and the preferred process proceeds to analyze the subsequently entered non-start key input in a step S104. In the step S104, it is further determined in the step SI 04 as to whether or not a help-information download task is activated by referring to a predetermined set of conditions.

Still referring to FIG. 7, the following five conditions are considered for the activation of the help-information download in the step S104. According to a first condition, the download task is activated as soon as one of the predetermined keys is pressed. According to a second condition, the download task is activated after a predetermined amount of time has elapsed since the last input in the step S101 and no other keys have been inputted. According to a third condition, the download task is activated after a predetermined amount of time has elapsed between two user key inputs. According to a fourth condition, the download task is activated after a predetermined frequency of a specified input key has been attained. According to a fifth condition, the download task is activated after a predetermined combination of the user input keys has been inputted. Any combination of the above five conditions is also used in another preferred process. For example, although the current user input key is not one of the specified keys under the first condition, if the predetermined amount of time has elapsed between two user key inputs under the third condition, it is determined in the step S104 that the condition has been met. If the activation condition has not been met in the step S104, the preferred process proceeds to a step S106. On the other hand, in case the activation condition has been met in the step S104, a processing task is initiated in a step S105 to determine as to whether or not a request is made to the help server 400 to download the help information that corresponds to the user input key from the image forming device 100. After the step S105, the function is performed for the input key in the step S106, and the preferred process returns to the step 101.

Figure 8:
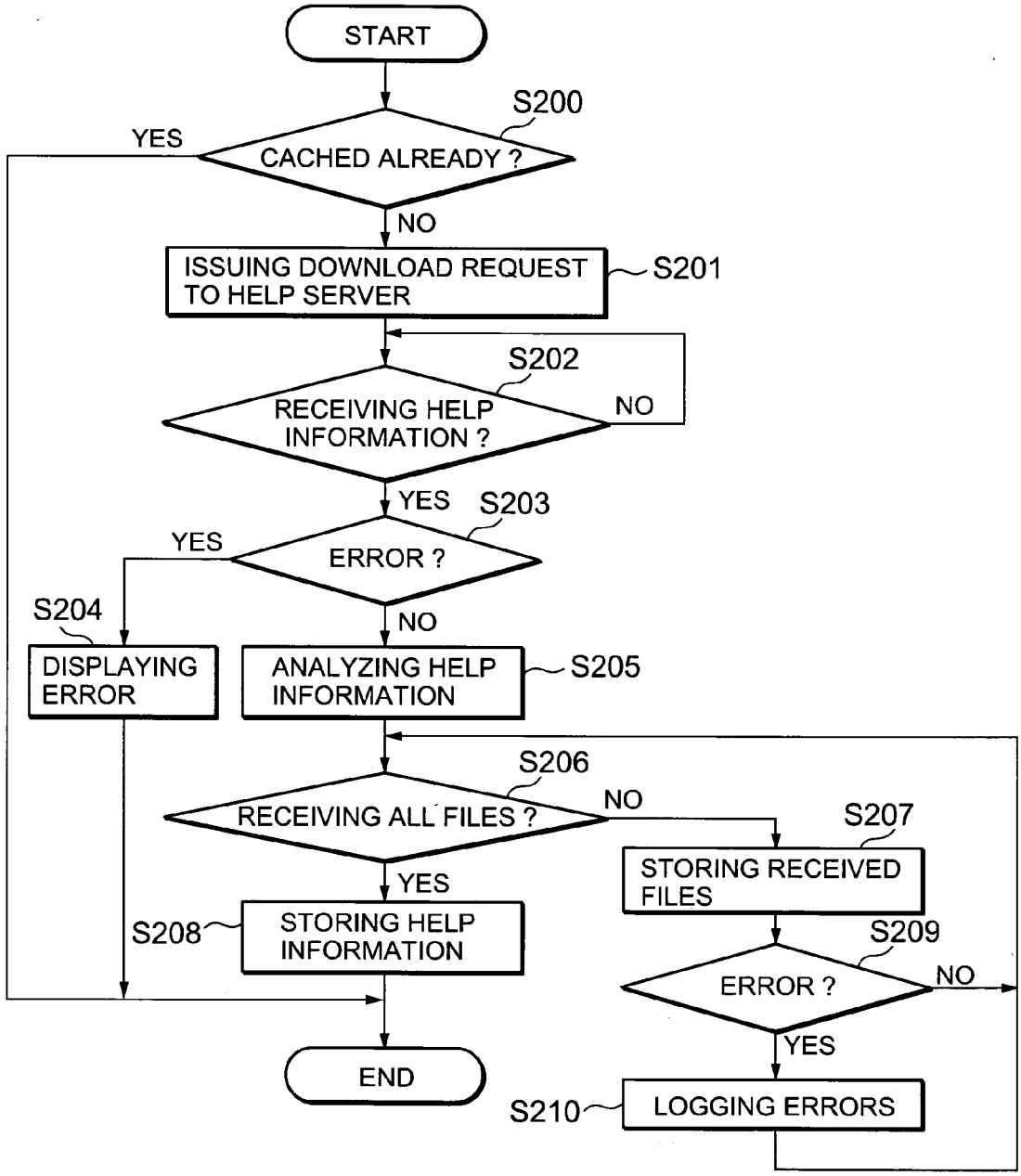
FIG. 8 is a flow chart illustrating steps involved in another preferred process of performing the on-line user support according to the current invention.

Now referring to FIG. 8, a flow chart illustrates steps involved in a preferred process of performing the on-line user support according to the current invention. When the help information is necessary, the corresponding current task is activated as a background process. In describing the steps in the preferred process, although the devices such as of the image-forming device 100 and the help server 400 or the units of these devices are referred, the implementation of the preferred process is not limited to these units or devices and is merely illustrative. In a step S200, it is determined whether or not a relevant help information set has already been cached in the cache of the information storage unit 102 of the image-forming device 100. If it is determined in the step S200 that the relevant help information set has already been cached, the preferred process terminates the current session. On the other hand, if it is determined in the step S200 that the relevant help information set has not yet been cached, the preferred process obtains from the information storage unit 102 in the image-forming device 100 a pointer or universal resource locator (URL), which points to a relevant help server 400 that stores the help information for the user input key. Based upon the above obtained URL, the preferred process now generates a request message or a get method and transmits the generated request message to the Internet 500 via the NIC unit 110 of the image-forming device 100 in a step S201. Thus, the preferred process issues a help information download request to the relevant help server 400 in the step S201.

Still referring to FIG. 8, the preferred process still performs the following steps to receive the help information in the cache memory from the help server 400. After issuing help information download request in the step S201, it is determined in a step S202 whether help server 400. In other words, the preferred process waits for the response message or the help information file in the step S202. Upon receiving the help response message from the help server 400, it is further determined in a step S203 whether or not a reception error has occurred. If it is determined in the step S203 that the reception error has occurred, the preferred process outputs the error log to an appropriate log file and or displays the error message in a step S204 before it terminates the current session. On the other hand, if is determined in the step S203 that no reception error has occurred, the preferred process analyzes the received help response message in the help information file in a step S205. The images, links, the font information and other related information are extracted from the received help response message in the step S205. Based upon the extracted information, it is further determined in a step S206 whether or not all of the related files for the received help response message have been received. If it is determined in the step S206 that all of the related files for the received help response message have been already received, the help information and separately transferred files are associated and stored in the cache memory of the information storage unit 102 in the image-forming device 100 in a step S208. On the other hand, if it is determined in the step S206 that all of the related files for the received help response message have not yet been received, the already received files containing data such as images are stored in the cache memory of the information storage unit 102 in the image-forming device 100 in a step S207. After caching in the step S207, it is determined whether or not a reception error has occurred in a step S209. If it is determined in the step S209 that the reception error has occurred, the preferred process outputs the error log to an appropriate log file and or displays the error message in a step S210 before it returns to the step S206. On the other hand, if is determined in the step S209 that no reception error has occurred, the preferred process simply returns to the step S206.

Figure 9:
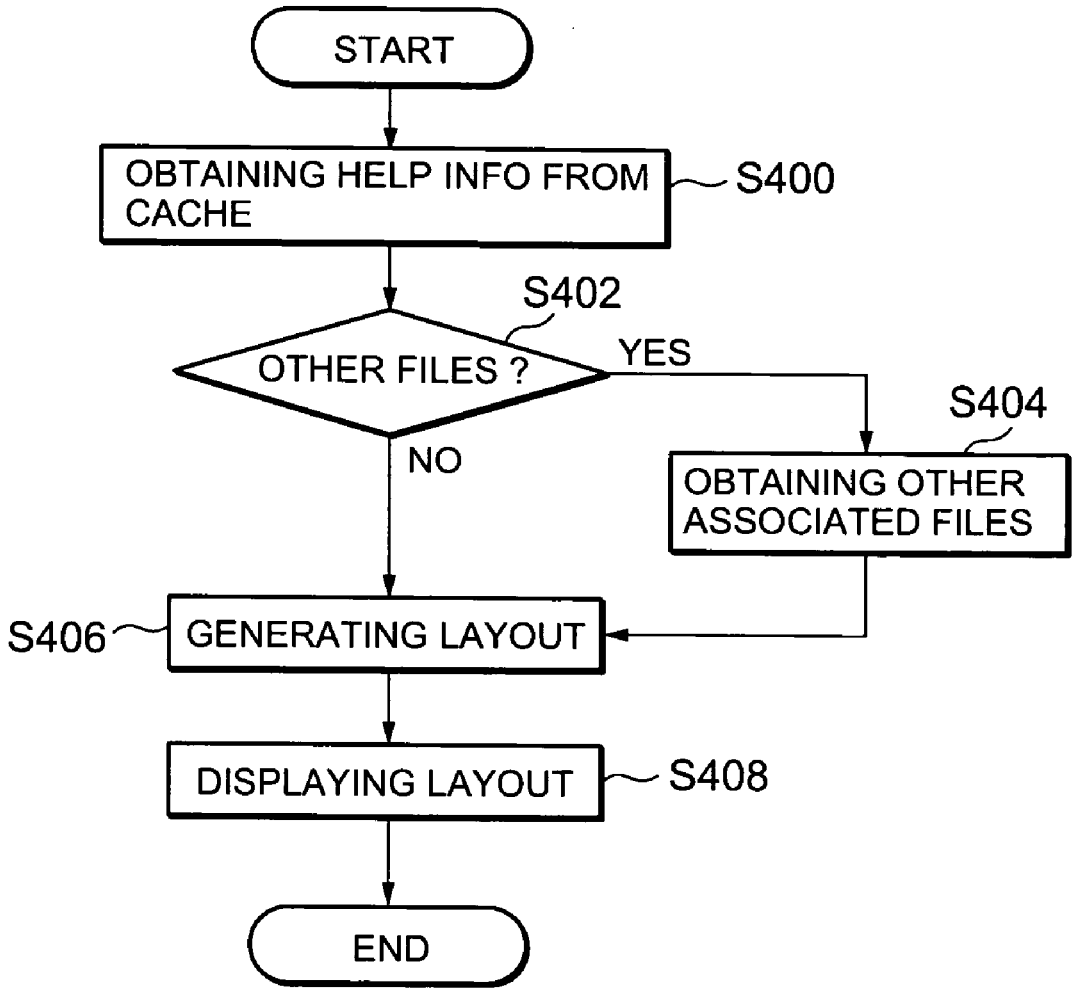
FIG. 9 is a flow chart illustrating steps involved in a preferred process of displaying the help information from the cache for the on-line user support according to the current invention.

Now referring to FIG. 9, a flow chart illustrates steps involved in a preferred process of displaying the help information from the cache for the on-line user support according to the current invention. In general, the contents of the downloaded help information file and the associated files are displayed together. In describing the steps in the preferred process, although the devices such as of the image-forming device 100 and the help server 400 or the units of these devices are referred, the implementation of the preferred process is not limited to these units or devices and is merely illustrative. Subsequent to the above described preferred process in FIG. 8, the body of the help information file is obtained in a step S400 from the cache memory in the information storage unit 102 of the image-forming device 100 before the help information is displayed. The obtained help information content is subsequently analyzed in a step S402 to determine necessary files containing information such as associated images for display. If it is determined in the step S402 that other files are not associated with the currently obtained help information file, the preferred process proceeds to a step S406. On the other hand, if it is determined in the step S402 that other files are necessarily associated with the currently obtained help information file, the preferred process obtains the contents of these associated files in a step S404 from the cache memory. After the associated files are obtained, a layout is generated to include the obtained help information and the associated data in the step S406. In addition, the font information and the link information are also added to generate the layout to be displayed in the display unit 109 such as a LCD in the image-forming device 100 in the step S406. The help information is not limited to the text but includes animation data such as in the GIF format and animation objects as expressed in JAVA applets. The audio information is also included in the help information as necessary. For the audio output, the image-forming device 100 optionally includes a speaker, an amplifier and an audio digital-to-analog (D/A) converter. The audio information is stored in a compressed audio data format as a part of the help information. Lastly, the layout containing the above help information and other associated data are outputted to the display unit 109 in the image-forming device 100 in a step S408.

Figure 10:
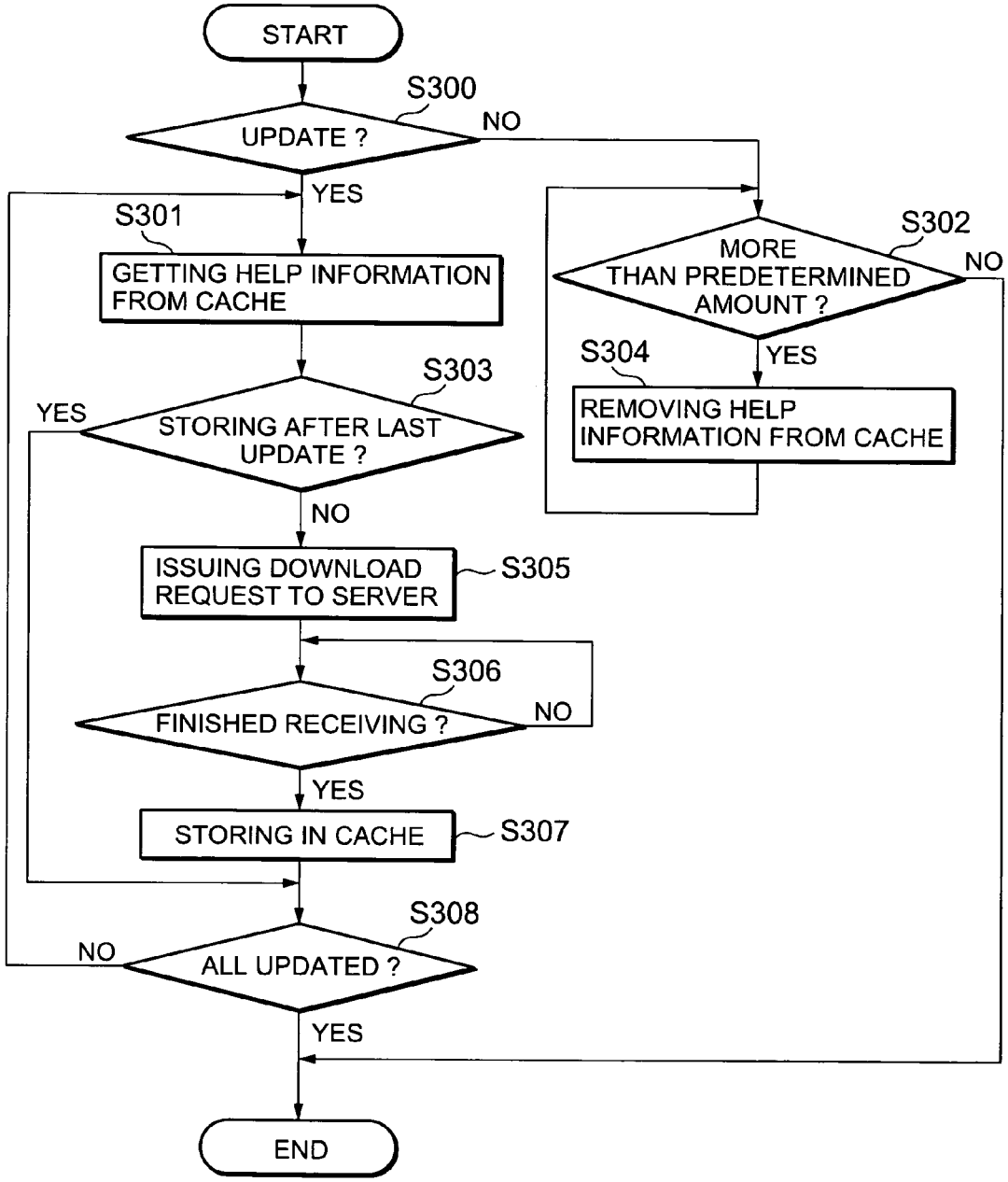
FIG. 10 is a flow chart illustrating steps involved in a preferred process of updating and removing the data associated with the help information in the cache memory according to the current invention.

Now referring to FIG. 10, a flow chart illustrates steps involved in a preferred process of updating and removing the data associated with the help information in the cache memory according to the current invention. In general, the cache management process is activated as a background task when the free cache space reaches a predetermined amount of space or a predetermined amount of time has elapsed for the help information update. In describing the steps in the preferred process, although the devices such as of the image-forming device 100 and the help server 400 or the units of these devices are referred, the implementation of the preferred process is not limited to these units or devices and is merely illustrative. It is determined in a step S300 whether or not an update is to take place based upon a predetermined condition such as a predetermined free cache space or a predetermined help information update time. If it is determined in the step S300 that the cache update is to take place, the preferred process obtains one of the help information from the cache memory in a step S301. For the obtained help information, it is determined in a step S303 whether or not the storage took place after the last cache memory update. If it is determined in the step S303 that the storage of the current help information took place after the last cache memory update, the preferred process proceeds to a step S308 for examining a next one of the help information in the cache memory.

On the other hand, if it is determined in the step S303 that the storage of the current help information took place before the last cache memory update, the preferred process proceeds to a step S305, where the preferred process issues a download request or a get method for the currently examined help information to the help server 400 through the Internet 500 via the NIC unit 110. In the step S305, the preferred process obtains a relevant pointer from the information storage unit 102 in the image-forming device 100. The download request includes the pointer or URL for the help server 400 and or the help information file that is stored in the help server 400. After the step S305, the preferred process waits for a response message from the help server 400 in a step S306. The response message contains the requested new help information. Upon receiving the response from the help server 400, the preferred process stores the newly received help information in the cache memory in the information storage unit 102 of the image-forming device 100 in a step S307. In a step S308, it is determined whether or not every piece of the help information has been updated according to the above described steps of the preferred process. If not all of the help information have been updated, the preferred process returns to the step S301 to examine a next piece of the help information in the cache memory. On the other hand, if all of the help information have been updated, the preferred process terminates the current session.

Still referring to FIG. 10, if it is determined in the step S300 that the cache update does need to take place according to the predetermined condition, the preferred process now determines in a step S302 whether or not the current storage amount in the memory cache exceeds a predetermined threshold memory level. If it is determined in the step S302 that the current storage amount in the memory cache does not yet exceed a predetermined threshold memory level, the preferred process terminates the current session. On the other hand, if it is determined in the step S302 that the current storage amount in the memory cache exceeds a predetermined threshold memory level, the preferred process attempts to remove some of the stored information in a step S304. Based upon the cache access log, the preferred process finds a piece of the help information in the cache memory that has not been accessed in a recent time period and removes the corresponding help information from the cache memory in the information storage unit 102 in the image-forming device 100 in the step S304. The preferred process then returns to the step S302 to repeat the removing task until the current storage amount in the memory cache becomes below the predetermined threshold memory level so that the preferred process terminates the current session.

As described above, the preferred process monitors a sequence of the user input keys in real time. When one of the above described predetermined conditions is met, the preferred process estimates that the user now experiences an unclear operation of the image-forming device 100. Based upon the estimation, the preferred process downloads the corresponding help information in advance of the user operational help request. The advance help information smoothly guides the user in properly operating the image-forming device 100 so that the user stress level is minimized and that the user satisfaction is substantially improved. Because of the advance help information substantially reduces the response time in obtaining the help information and consequently reduces the operational interruption time. Furthermore, the help information is customized to the user operation or environment due to the centrally managed data in the help servers. Thus, the operation of the image-forming device is substantially improved for convenience.

Because of the centrally managed help information, the updates in the new help information and the removal of the old help information are performed without the user involvement. As described above, the downloaded help information is the cache memory is guaranteed to be the most updated version in the help server 400 according to the current invention. At the same time, the preferred process also utilizes the cache memory in an efficient manner so that the size of the cache memory does not have to be extended. As also described above, when the free cache memory falls below a predetermined threshold level, the existing cache content is reviewed so that the old or not accessed help information is removed from the cache. Because of the above features, the help information is available in the cache at reasonable manufacturing costs of the image-forming device.

The functions as described with respect to the image-forming device and the help server are implemented in data and software programs that are stored in recording media such as a CD-ROM. The data and software programs in the CD-ROM are read by a recording media reading unit in the image-forming device and the help server. The CPU of the image-forming device and the help server executes the above software programs to perform the steps or tasks of the functions according to the current invention. The recording media also further include semiconductor media such as ROM and NV-RAM, optical media such as DVD, MO, MD and CD, magnetic media such as magnetic tape and magnetic disks. The software programs and the data are also delivered via the network to a server, which acts as a recording medium. In any of the above cases, the recording media containing the software programs and the data are also considered as the current invention.

Lastly, the functions that are implemented by the software programs involve the functions or steps that are performed by the operating system or other software programs in response to the software programs. All of these software programs are considered to be a part of the current invention in implementing the features of the current invention.

It is to be understood, however, that even though numerous characteristics and advantages of the present invention have been set forth in the foregoing description, together with details of the structure and function of the invention, the disclosure is illustrative only, and that although changes may be made in detail, especially in matters of shape, size and arrangement of parts, as well as implementation in software, hardware, or a combination of both, the changes are within the principles of the invention to the full extent indicated by the broad general meaning of the terms in which the appended claims are expressed.

What is claimed is:

1. A method of helping a user in operating an image-forming device that is connected to a help server via a network, comprising the steps of:

monitoring a user key input sequence of user input keys at the image-forming device;

determining a user confusion state in operating the image-forming device based upon the monitored user key input sequence;

automatically downloading from the help server a relevant set of help information in accordance with the user confusion state; and temporarily storing the relevant set of the help information in a temporary memory unit at the image-forming device in advance of a user help request for the relevant set of the help information.

2. The method of helping a user in operating an image-forming device according to claim 1 further comprising additional steps of:

monitoring the user help request that is associated with the user confusion state; and in response to the user help request, displaying the relevant set of the help information from the temporary memory unit.

3. The method of helping a user in operating an image-forming device according to claim 1 wherein the user key input sequence is a predetermined sequential combination of the user input keys.

4. The method of helping a user in operating an image-forming device according to claim 1 wherein the user key input sequence is a predetermined set of the user input keys.

5. The method of helping a user in operating an image-forming device according to claim 1 wherein the user key input sequence is a predetermined amount of time between the user input keys.

6. The method of helping a user in operating an image-forming device according to claim 1 wherein the user key input sequence is a predetermined amount of time between an initial one of the user input keys and a last one of the user input keys.

7. The method of helping a user in operating an image-forming device according to claim 1 wherein the user key input sequence is a predetermined amount of frequency for a predetermined set of the user input keys.

8. The method of helping a user in operating an image-forming device according to claim 1 wherein the relevant set of the help information is in a series of associated files, claim 1 further comprising an additional step of determining whether not all of the associated files are downloaded before temporarily storing the help information.

9. The method of helping a user in operating an image-forming device according to claim 8 wherein the associated files include audio data and animation data.

10. The method of helping a user in operating an image-forming device according to claim 8 further comprising additional steps of:

monitoring the user help request that is associated with the user confusion state; and in response to the user help request, generating a layout from all of the associated files that have been temporarily stored for the help information; and displaying the layout for the help information at the image-forming device.

11. The method of helping a user in operating an image-forming device according to claim 1 further comprising additional steps of:

determining whether or not the relevant set of the help information exists in the temporary memory unit at the image-forming device before downloading the relevant set of the help information from the help server to generate a result signal;

obtaining a pointer indicative of a memory location of the relevant help information in the help server; and locating the relevant set of the help information based upon the pointer.

12. The method of helping a user in operating an image-forming device according to claim 1 further comprising an additional step of updating the relevant set of the help information in the temporary storage based upon a predetermined condition.

13. The method of helping a user in operating an image-forming device according to claim 1 wherein the temporary memory unit is cache memory.

14. The method of helping a user in operating an image-forming device according to claim 1 wherein the help information is centrally maintained and updated at the help server.

15. A computer program product for helping a user in operating an image-forming device that is connected to a help server via a network, said computer program product comprising a computer-readable storage medium having computer-readable instructions embedded in the storage medium and performing the tasks of:

monitoring a user key input sequence of user input keys at the image-forming device; and determining a user confusion state in operating the image-forming device based upon the monitored user key input sequence; and automatically downloading from the help server a relevant set of help information in accordance with the user confusion state; and temporarily storing the relevant set of the help information in a temporary memory unit at the image-forming device in advance of a user help request for the relevant set of the help information.

16. The computer program product for helping a user in operating an image-forming device according to claim 15 further performing additional tasks of:

monitoring the user help request that is associated with the user confusion state; and in response to the user help request, displaying the relevant set of the help information from the temporary memory unit.

17. The computer program product for helping a user in operating an image-forming device according to claim 15 wherein the user key input sequence is a predetermined sequential combination of the user input keys.

18. The computer program product for helping a user in operating an image-forming device according to claim 15 wherein the user key input sequence is a predetermined set of the user input keys.

19. The computer program product for helping a user in operating an image-forming device according to claim 15 wherein the user key input sequence is a predetermined amount of time between the user input keys.

20. The computer program product for helping a user in operating an image-forming device according to claim 15 wherein the user key input sequence is a predetermined amount of time between an initial one of the user input keys and a last one of the user input keys.

21. The computer program product for helping a user in operating an image-forming device according to claim 15 wherein the user key input sequence is a predetermined amount of frequency for a predetermined set of the user input keys.

22. The computer program product for helping a user in operating an image-forming device according to claim 15 wherein the relevant set of the help information is in a series of associated files, claim 15 further performing an additional task of determining whether not all of the associated files are downloaded before temporarily storing the help information.

23. The computer program product for helping a user in operating an image-forming device according to claim 22 wherein the associated files include audio data and animation data.

24. The computer program product for helping a user in operating an image-forming device according to claim 22 further performing additional tasks of:

monitoring the user, help request that is associated with the user confusion state; and in response to the user help request, generating a layout from all of the associated files that have been temporarily stored for the help information; and displaying the layout for the help information at the image-forming device.

25. The computer program product for helping a user in operating an image-forming device according to claim 15 further performing additional tasks of:

determining whether or not the relevant set of the help information exists in the temporary memory unit at the image-forming device before downloading the relevant set of the help information from the help server to generate a result signal;

obtaining a pointer indicative of a memory location of the relevant set of the help information in the help server; and locating the relevant set of the help information based upon the pointer.

26. The computer program product for helping a user in operating an image-forming device according to claim 15 further performing an additional task of updating the relevant set of the help information in the temporary storage based upon a predetermined condition.

27. The computer program product for helping a user in operating an image-forming device according to claim 15 wherein the temporary memory unit is cache memory.

28. The computer program product for helping a user in operating an image-forming device according to claim 15 wherein the help information is centrally maintained and updated at the help server.

29. A system for helping a user in operating an image-forming device via a network, comprising:

a help server connected to the network for storing help information; and an image-forming device connected to the network and having a user input unit for monitoring a user key input sequence of user input keys and an information processing unit for determining a user confusion state in operating the image-forming device based upon the monitored user key input sequence, said image-forming device further including an I/O control unit for downloading from said help server a relevant set of the help information in accordance with the user confusion state, said image-forming device further including a temporary memory unit for temporarily storing the relevant set of the downloaded help information at the image-forming device in advance of a user help request for the relevant set of the help information.

30. The system for helping a user in operating an image-forming device according to claim 29 wherein said user input unit monitors the user help request that is associated with the user confusion state, said image-forming device further comprising a display unit for displaying the relevant set of the help information from the temporary memory unit in response to the user help request.

31. The system for helping a user in operating an image-forming device according to claim 29 wherein the user key input sequence is a predetermined sequential combination of the user input keys.

32. The system for helping a user in operating an image-forming device according to claim 29 wherein the user key input sequence is a predetermined set of the user input keys.

33. The system for helping a user in operating an image-forming device according to claim 29 wherein the user key input sequence is a predetermined amount of time between the user input keys.

34. The system for helping a user in operating an image-forming device according to claim 29 wherein the user key input sequence is a predetermined amount of time between an initial one of the user input keys and a last one of the user input keys.

35. The system for helping a user in operating an image-forming device according to claim 29 wherein the user key input sequence is a predetermined amount of frequency for a predetermined set of the user input keys.

36. The system for helping a user in operating an image-forming device according to claim 29 wherein the relevant set of the help information is in a series of associated files, wherein said information processing unit determining whether not all of the associated files are downloaded before temporarily storing the help information.

37. The system for helping a user in operating an image-forming device according to claim 36 wherein the associated files include audio data and animation data.

38. The system for helping a user in operating an image-forming device according to claim 36 wherein said user input unit monitors a user help request that is associated with the user confusion state, said information processing unit generating a layout from all of the associated files that have been temporarily stored for the help information, said image-forming device further comprising a display unit for displaying the layout for the help information at the image-forming device.

39. The system for helping a user in operating an image-forming device according to claim 29 wherein said information processing unit determines whether or not the relevant set of the help information exists in the temporary memory unit at the image-forming device before downloading the relevant set of the help information from said help server to generate a result signal, said information processing unit obtaining a pointer indicative of a memory location of the relevant set of the help information in said help server and locating the relevant set of the help information based upon the pointer.

40. The system for helping a user in operating an image-forming device according to claim 29 wherein said information processing unit updates the relevant set of the help information in the temporary storage based upon a predetermined condition.

41. The system for helping a user in operating an image-forming device according to claim 29 wherein the temporary memory unit is cache memory.

42. The system for helping a user in operating an image-forming device according to claim 29 wherein said help server centrally maintains and updates the help information.

* * * * *